US009752232B2

(12) United States Patent
Porodo et al.

(10) Patent No.: US 9,752,232 B2
(45) Date of Patent: Sep. 5, 2017

(54) METHOD OF ELECTROLESSLY PLATING NICKEL ON TUBULARS

(71) Applicants: Dan Porodo, Calmar (CA); Stewart Thompson, Calgary (CA)

(72) Inventors: Dan Porodo, Calmar (CA); Stewart Thompson, Calgary (CA)

( * ) Notice: Subject to any disclaimer, the term of this patent is extended or adjusted under 35 U.S.C. 154(b) by 0 days.

(21) Appl. No.: 15/154,691

(22) Filed: May 13, 2016

(65) Prior Publication Data

US 2016/0333480 A1 Nov. 17, 2016

Related U.S. Application Data

(60) Provisional application No. 62/161,048, filed on May 13, 2015.

(51) Int. Cl.

| | |
|---|---|
| ***C23C 18/32*** | (2006.01) |
| ***B05D 7/22*** | (2006.01) |
| ***C23C 18/16*** | (2006.01) |
| ***C23C 18/18*** | (2006.01) |
| ***B05D 7/24*** | (2006.01) |
| ***B05D 3/00*** | (2006.01) |
| ***B05D 1/18*** | (2006.01) |

(52) U.S. Cl.

CPC ..... *C23C 18/163* (2013.01); *B05D 1/18* (2013.01); *B05D 3/002* (2013.01); *B05D 7/222* (2013.01); *B05D 7/225* (2013.01); *B05D 7/24* (2013.01); *C23C 18/1601* (2013.01); *C23C 18/1603* (2013.01); *C23C 18/1605* (2013.01); *C23C 18/1616* (2013.01); *C23C 18/1619* (2013.01); *C23C 18/1623* (2013.01); *C23C 18/1632* (2013.01); *C23C 18/1633* (2013.01); *C23C 18/1664* (2013.01); *C23C 18/1669* (2013.01); *C23C 18/1675* (2013.01); *C23C 18/1806* (2013.01); *C23C 18/1824* (2013.01); *C23C 18/1834* (2013.01); *C23C 18/1844* (2013.01); *C23C 18/32* (2013.01); *B05D 2254/00* (2013.01); *B05D 2254/02* (2013.01); *B05D 2254/04* (2013.01); *B05D 2254/06* (2013.01); *B05D 2350/30* (2013.01)

(58) Field of Classification Search

CPC ..... B05D 1/18; B05D 3/002; B05D 7/222; B05D 7/225; B05D 7/24; B05D 2254/00; B05D 2254/02; B05D 2254/04; B05D 2254/06; B05D 2350/30; C23C 18/16; C23C 18/1601; C23C 18/1603; C23C 18/1605; C23C 18/1619; C23C 18/163; C23C 18/1632; C23C 18/1633; C23C 18/18; C23C 18/1806; C23C 18/1824; C23C 18/32; C23C 18/34

USPC ..... 427/230, 235, 239, 304, 437, 443.1; 118/408, DIG. 10, DIG. 11, DIG. 12, 118/DIG. 13; 138/145; 205/187; 106/1.22

See application file for complete search history.

(56) References Cited

U.S. PATENT DOCUMENTS

| | | | | |
|---|---|---|---|---|
| 4,262,044 A | | 4/1981 | Kuczma, Jr. | |
| 5,256,441 A | * | 10/1993 | Huenger | C23C 18/1617 427/305 |
| 8,387,555 B2 | * | 3/2013 | Wang | C23C 18/1616 118/300 |
| 2007/0193510 A1 | * | 8/2007 | Saijo | C23C 18/1619 118/429 |
| 2011/0206532 A1 | * | 8/2011 | Sorbo | C23C 18/32 416/241 R |

FOREIGN PATENT DOCUMENTS

| | | | |
|---|---|---|---|
| CN | 103737137 A | * | 4/2014 |
| GB | 1064295 A | * | 4/1967 |
| WO | WO 2014/038325 A1 | * | 3/2014 |

OTHER PUBLICATIONS

Wang et al., "A facile method of nickel electroless deposition on various neutral hydrophobic polymer surfaces," Applied Surface Science 283 (2013) 309-320.*

Avion Manufacturing Company "Stop-Off Coatings", www.avionmfg.com, 1 page; downloaded Jun. 29, 2016.

* cited by examiner

*Primary Examiner* — William Phillip Fletcher, III

(74) *Attorney, Agent, or Firm* — Seed IP Law Group LLP

(57) ABSTRACT

Tubulars are immersed in electroless nickel coating solution to coat the tubulars. Prior to the coating step the tubulars are blasted with a clean medium and washed and rinsed in alkaline solution. The tubulars are arranged in a bunk for washing, rinsing and coating. LLDPE stretch wrap applied to outer portions of the tubulars prevents coating of the outer portions. The tubulars are electrically separated from the bunk and the coating solution tank, and the tank is provided with anodic protection to prevent coating of the tank. The bunk is provided with a header assembly to provide solution flow through the tubulars via nozzles on the header assembly in addition to flow caused by the vortex effect created by velocity of fluid exiting the nozzles. The bunk is arranged in the solution tank so that the tubulars are at an angle to horizontal to efficiently remove hydrogen gas. Solution flow to the header assembly is filtered to remove particulates.

18 Claims, 7 Drawing Sheets

METHOD OF ELECTROLESSLY PLATING NICKEL ON TUBULARS

BACKGROUND

Technical Field

Electroless coating, particularly of tubulars.

Description of the Related Art

Electroless nickel coatings (ENC) have been used very successfully to improve components used in oil and gas applications. A number of technical challenges arise when trying to process long tubular parts used in oil and gas. Previous attempts to address these challenges (under related art Kuczma, U.S. Pat. No. 4,262,044, and Wang, U.S. Pat. No. 8,387,555, etc.) fall short in their ability to properly address these challenges based on successful production scale processing and the requirements of the end users of these parts.

BRIEF SUMMARY

This disclosure provides a comprehensive system (referred to as MAC system) to apply ENC to long tubulars that specifically addresses the issues that previously limited its use for this application. The MAC system uses special mechanical pre-treatment, a newly developed stop off method (separate patent pending), an acid free pre-treatment cycle, specialized fixturing, and custom developed filtered flow systems to yield production parts with a high degree of coating uniformity, a superior bond strength, and minimal porosity. It will become obvious in the presentation of the details of said disclosure that no previous attempts have properly addressed the challenges that the use of ENC on long 10m+length tubulars creates.

There is provided a method of coating tubulars, the method comprising immersing the tubulars in electroless nickel coating solution, the tubulars being oriented in the electroless nickel coating solution at an angle greater than 0 degrees and less than 30 degrees from horizontal, and providing a flow of the electroless nickel coating solution through the tubulars to coat the tubulars. In various embodiments, there may be included any one or more of the following features: the tubulars may be washed in an alkaline washing solution and rinsed in an alkaline rinsing solution before immersing the tubulars in the electroless nickel coating solution, the tubulars may be blasted with a clean medium prior to washing the tubulars, the tubulars may be immersed in the electroless nickel coating solution in a tank from which the tubulars are electrically separated, and the tank may be provided with anodic protection to prevent coating of the tank, the tubulars may each be provided with a wrapping to prevent coating of a respective outer portion of the tubular, the wrapping may comprise LLDPE (linear low-density polyethylene) stretch wrap, the tubulars may be arranged in a bunk and the step of immersing the tubulars in electroless nickel coating solution to coat the tubulars may occur while the tubulars are arranged in the bunk, electroless nickel coating solution flow may be provided through the tubulars from nozzles on a header assembly attached to the bunk, and the electroless nickel coating solution may enters the header assembly via a flow path comprising a filter.

There is also provided a method of coating tubulars, the method comprising washing the tubulars in an alkaline washing solution, rinsing the tubulars in an alkaline rinsing solution, and immersing the tubulars in electroless nickel coating solution to coat the tubulars. In various embodiments, there may be included any one or more of the following features: the tubulars may be blasted with a clean medium prior to washing the tubulars, the tubulars may be immersed in the electroless nickel coating solution in a tank from which the tubulars are electrically separated, and the tank may be provided with anodic protection to prevent coating of the tank, the tubulars may each be provided with a wrapping to prevent coating of a respective outer portion of the tubular, the wrapping may comprise LLDPE (linear low-density polyethylene) stretch wrap, the tubulars may be arranged in a bunk and the step of immersing the tubulars in electroless nickel coating solution to coat the tubulars may occur while the tubulars are arranged in the bunk, electroless nickel coating solution flow may be provided through the tubulars from nozzles on a header assembly attached to the bunk, and the electroless nickel coating solution may enters the header assembly via a flow path comprising a filter.

These and other aspects of the device and method are set out in the claims, which are incorporated here by reference.

BRIEF DESCRIPTION OF THE DRAWINGS

Embodiments will now be described with reference to the figures, in which like reference characters denote like elements, by way of example, and in which.

DETAILED DESCRIPTION

An object of the MAC system is to provide a unique method to ENC coat long tubular parts and early in the development of this disclosure it was recognized that a successful system must take in to account the interdependency of the various processing steps in order to achieve the goal of meeting end user requirements.

It was recognized early that acid pickling when used as a pre-treatment step had serious drawbacks. These include the etching of the steel substrate at grain boundaries, the resulting highly active surface that rapidly re-oxidizes putting extreme limitations on the transfer time of large loads of pipe, and the risk of increased iron contamination in the acidic based autocatalytic nickel process bath. For the above reasons the MAC system utilizes no acidic pre-treatment steps and even rinsing steps are deliberately kept in the alkaline range of pH to limit oxide formation to a thin monolayer. To eliminate acid processing the pipe is mechanically de-oxidized using ultra clean media with a technique that provides a desired surface profile. It has been previously recognized that surface profile is an important substrate factor for ENC coating applications so this was incorporated into the acid free pre-treatment of the MAC system.

Figure 5:
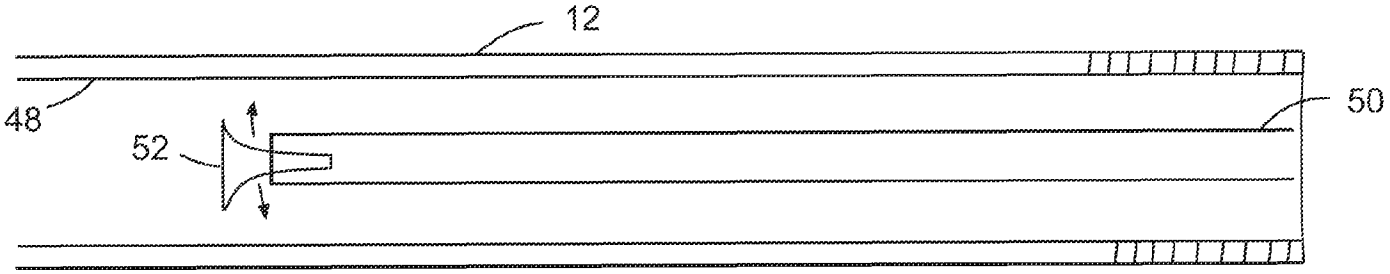
FIG. 5 is a side cutaway view of a pipe being blasted with a blasting system using a blast deflector.
Figure 6:
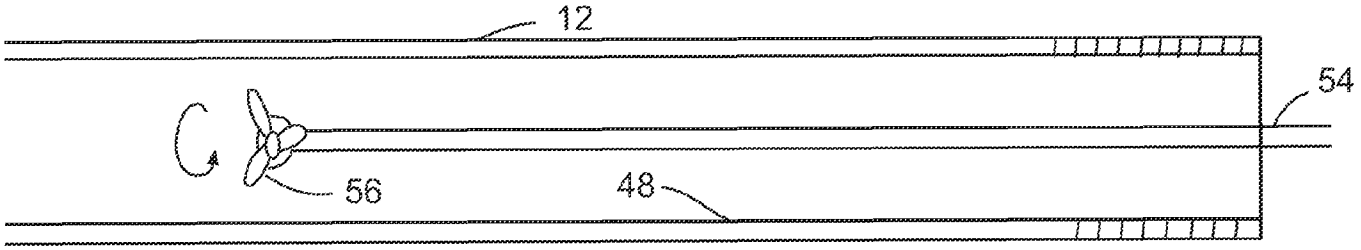
FIG. 6 is a side cutaway view of a pipe being blasted with a blasting system using a rotary blast head.
Figure 8A:
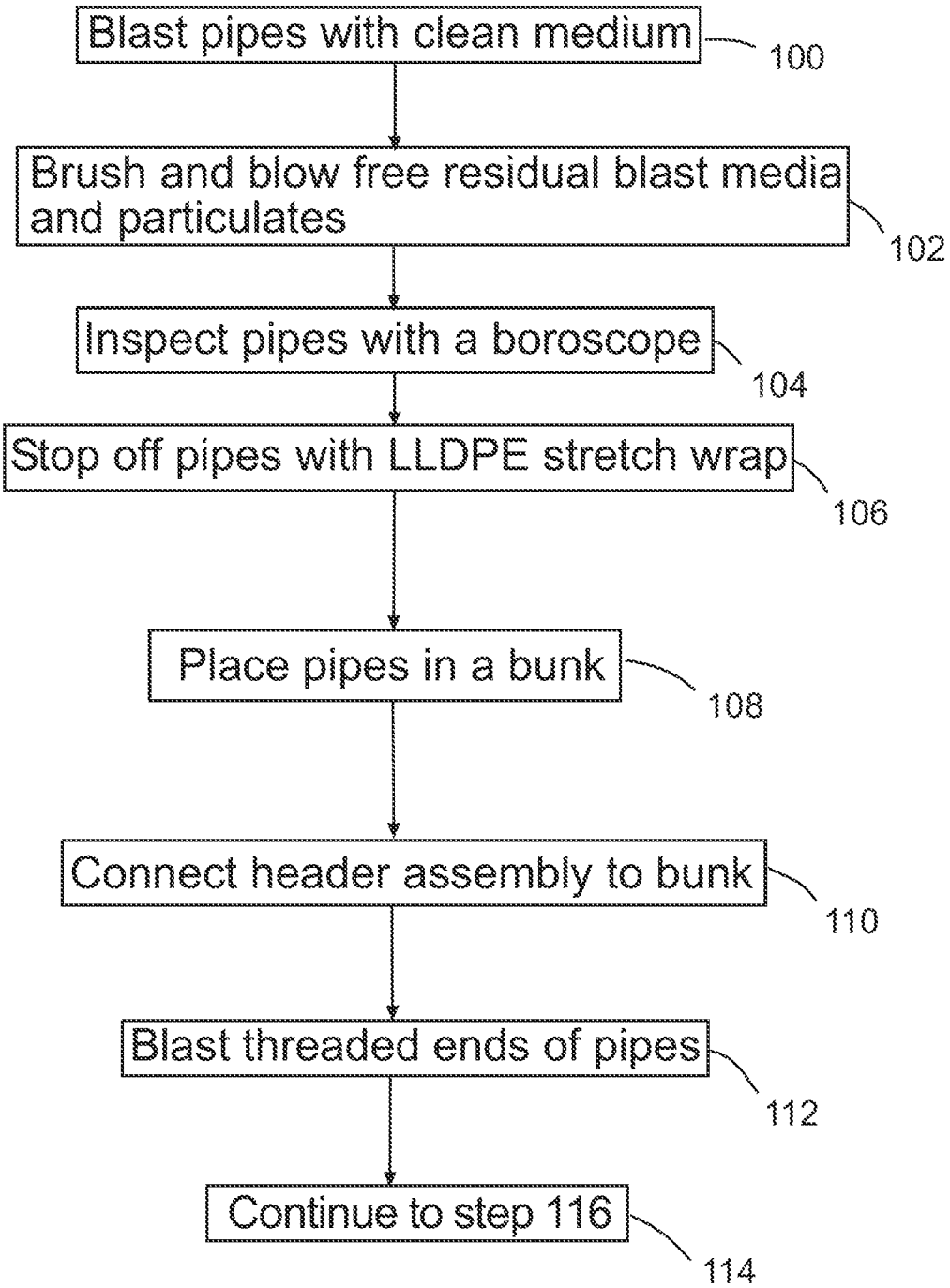
FIG. 8A is a flow chart indicating a first part of a method for preparing pipes for coating.

Referring to FIG. 8A, in step 100 the surfaces of the pipe that are to be coated are blasted using virgin media that is free from contamination. The type of media, the particle size, the blast pressure, and the angle of impingement are all controlled to produce a nominal surface profile to enhance the adhesion of the autocatalytic nickel deposit. The nominal surface profile has an average surface roughness (Ra) in microns as measured by a profilometer of between 2 and 5. For inside surfaces the blast instrument is operated in a manner that ensures a complete and uniform coverage of the surface. FIG. 5 and FIG. 6 show different blast instruments that can be used. In FIG. 5, a rigid blast pipe 50 is inserted into a pipe 12. Blast media and pressurized air is sent through the pipe and is deflected by blast deflector 52 to impact on inner surface 48 of the pipe 12. Deflector 52 may comprise for example carbide. In FIG. 6, a rigid blast line 54 is inserted into a pipe 12. Blast media and pressurized air is sent through the blast line and is directed onto the inner surface 48 of the pipe by a rotary blast head 56 driven by the flow of compressed air through the blast line. All blasted pipes are carefully inspected inside and out to ensure that the mechanical preparation has been correctly done to all applicable surfaces. The threaded ends of pipes are blasted in a separate final step 112 immediately prior to alkaline cleaning. Blasted pipe must be moved on to further processing within 8 hours and must be stored in an area of acceptably low relative humidity and protected from moisture which could result in unacceptable oxidation of the surface.

After blasting is completed all surfaces are brushed and blown free in step 102 of all residual blast media, metal fines, oxide residues, and particulates. Compressed or blower air used for this purpose must be completely free of any traces of oil or water. Each pipe is then inspected with a borescope in step 104 to ensure no gross amounts of blasting media or other particulates are present. Then the pipes are stopped off if required using LLDPE stretch wrap in step 106 and ends are sealed with high temp PVC tape.

Figure 1:
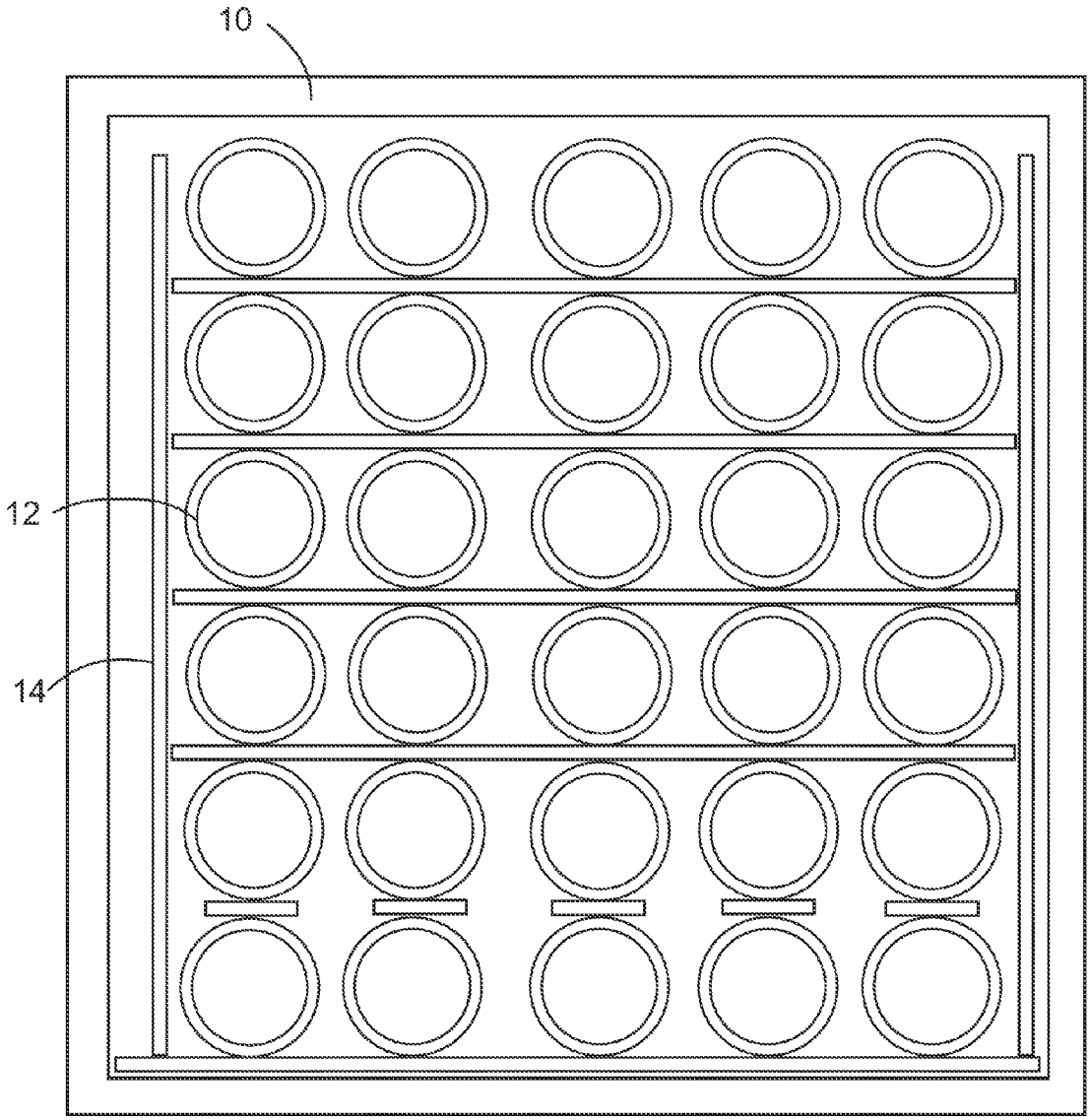
FIG. 1 is an end view of a bunk containing pipes for coating using electroless nickel coating.
Figure 2:
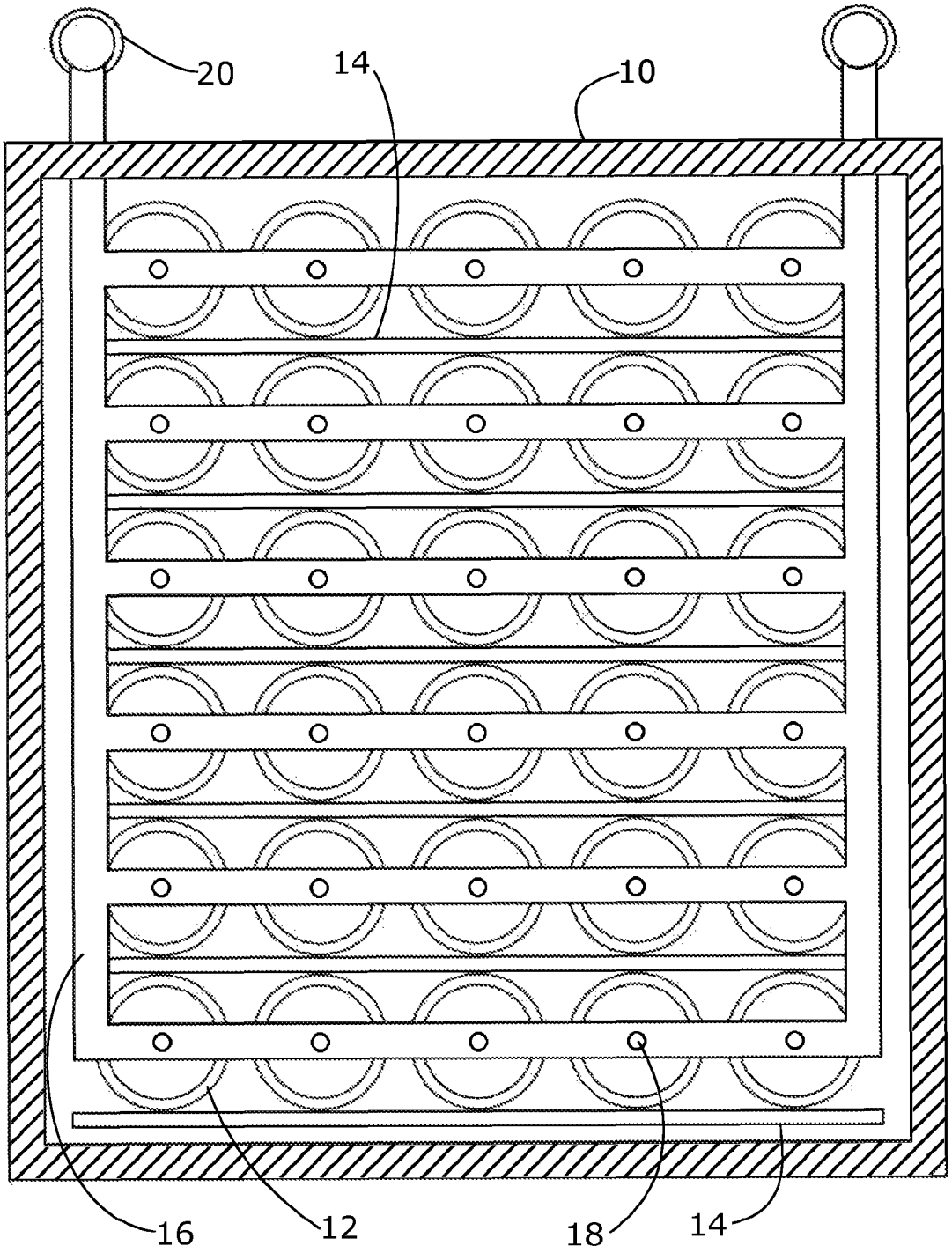
FIG. 2 is an end view of the bunk of FIG. 1 with a header attached.
Figure 7:
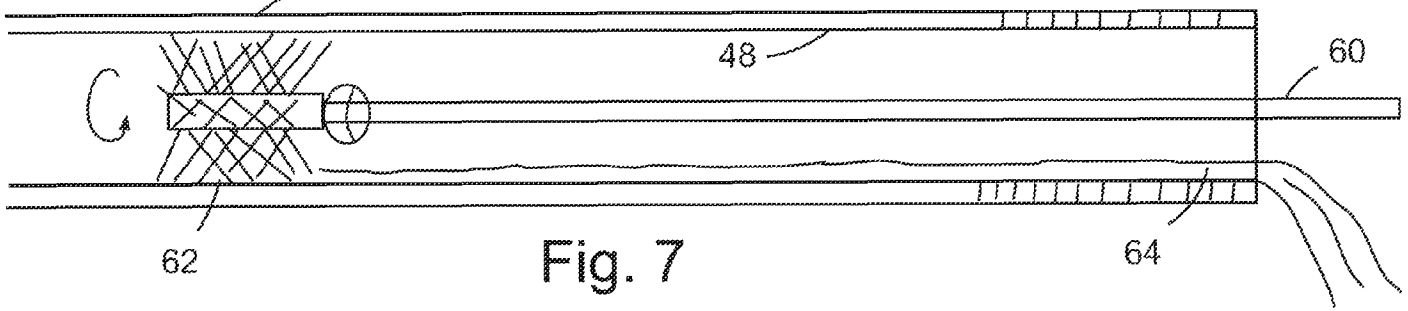
FIG. 7 is a side cutaway view of a pipe being brushed.
Figure 8B:
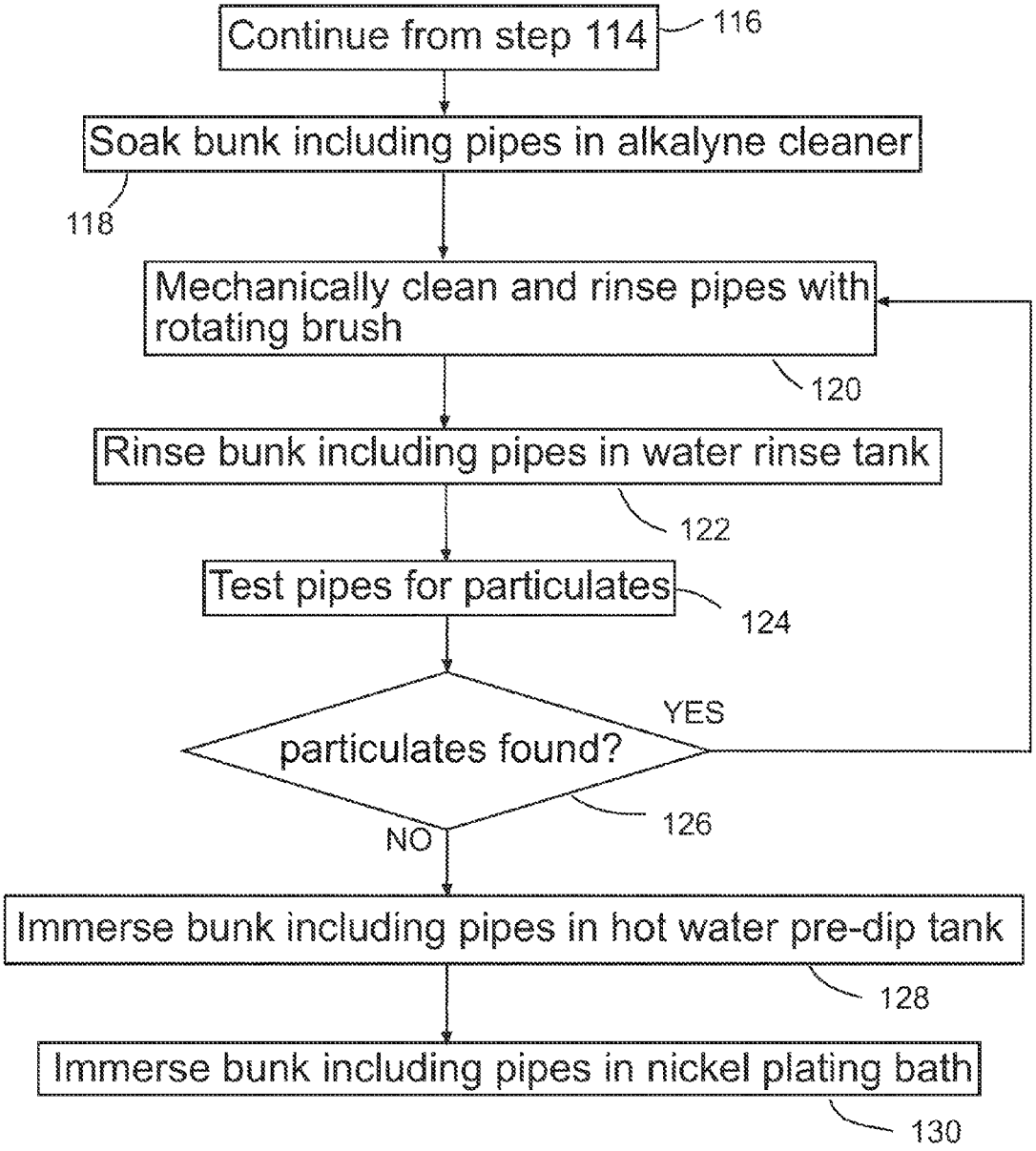
FIG. 8B is a flow chart indicating a second part of the method for preparing pipes for coating of FIG. 8A.

The pipes are then carefully positioned in step 108 into stainless steel bunks and spacers are used to ensure no electrical contact with the bunk is made. Rows of pipes are layered and carefully spaced and aligned to match up with the manifold of the header system used to pump bath through each pipe in the tank. FIG. 1 shows a bunk 10 with pipes 12 arranged and separated from the bunk with spacers 14. Once a full load has been placed in a bunk, in step 110 the header assembly is carefully aligned up and fixed in position with stainless steel clamps. FIG. 2 shows the header assembly 16 in place on a bunk. Circles 18 indicate the positions of outflow nozzles on the opposite side of the header. In use the header assembly provides solution flow through the tubulars via the nozzles on the header assembly in addition to flow caused by the vortex effect created by velocity of fluid exiting the nozzles, which vortex draws additional coating solution from the bath through the tubulars Quick disconnect fittings 20 extend upwards from the bunk for connection to an external circuit. After the threaded ends of the pipes are blasted in step 112, the process continues from what is shown in the flow chart of FIG. 8A to what is shown in the flow chart of FIG. 8B, as indicated by connecting steps 114 and 116. The bunk load is then lowered into the alkaline cleaner which is maintained within a controlled range of temperature and concentration and is replaced after processing a given number of loads. In step 118 the load is allowed to soak in the alkaline cleaner for 30 minutes. Then the bunk is lifted up and placed over an empty tank and each pipe is mechanically cleaned in step 120 with a high speed rotating brush with flowing DI rinse water that is pH regulated using ammonia to maintain a pH of 9. FIG. 7 shows a brush for cleaning the inside of a pipe 12. Alkaline cleaner or water containing ammonia is directed through a flexible hose 60 to a brush 62 within the pipe. The brush 62 rotates rapidly driven by the flow of fluid through the hose. Water exiting the hose flows back through the pipe as return flow 64. After each pipe is thoroughly cleaned by brushing and rinsing inside the outside is also cleaned in a similar manner. Following the cleaning the load is fully immersed in step 122 in a DI water rinse tank for further rinsing (this rinse tank also adjusted with ammonia to a pH of 9). After the immersion rinsing an acceptance test is run in step 124 for example using a clean white cloth that has been dipped into the rinse tank. The cloth is inserted into the pipes and surfaces are wiped to ensure that the cleaning stage has effective removed all residual particulates from the mechanical de-oxidation step. The cloth should come out clean with no particulates. In decision step 126 if particulates are detected then the cleaning and testing steps 120-126 are repeated. Once the load has passed it is immersed in step 128 in the hot DI water pre-dip tank which is maintained at 170 F. with a pH of 10 using ammonia additions. This hot DI water tank is made up new after 10 loads using high quality DI water (less than 5 micro Siemens conductivity) and during use is constantly filtered through a granulated carbon packed filtration unit operating with a flow rate of 5000 us gal per hour.

A critical need when processing tubulars with ENC is an effective stop off method since a large amount of pipe only requires coating on the ID. The stop off method must be cost effective, must withstand the high bath temperature, must remain securely in place to prevent severe contamination of the process baths, must self-seal in the event of a small breach, and must be easily applied and removed. It was found that LLDPE stretch wrap was ideal material for this application and was incorporated into the MAC system. Autocatalytic nickel plating baths have one of the highest requirements for being kept free from contamination and it is extremely important that all traces of dirt, oil, grease, pipe dope, rust, etc. be kept from entering the bath. It is quite common for tubulars used in the oil and gas industry to be contaminated with these materials so the effectiveness of the stop off cannot be overstated.

The need for a solution exchange system has been previously reported (Wang U.S. Pat. No. 8,387,555) but without detailing the need for such a system. Firstly for the ENC process bath to operate correctly the chemistry must stay within a tightly controlled range (+ or −5%). This fact combined with the very low inventory that exists in ENC process baths (~6 g/l of Ni) compared to typical Ni electroplating baths (75 g/L of Ni) and the high bath loading situation that occurs inside of the pipe creates a need for good solution exchange. This exchange helps ensure the required coating uniformity is obtained along the length of the pipe.

After load has been in pH adjusted hot DI water pre dip (at 170 F.+ or −5 F.) for time not less than 15 minutes or not more than 25 minutes the load is moved to the autocatalytic nickel plating tank in step 130. Once immersed in the nickel bath the header manifold is connected to two Flo King™ BX5000 in tank filters (each capable of providing 5000 gal/hr of EN bath that has been passed through a gradient filter with a 95% first pass capture rate of particles greater than 5 microns. The entire solution of electroless solution volume is also filtered at a rate of for example 10 times per hour for example using several Flo King™ BX5000 pumps inside the bath to ensure the solution is filtered to capture particulates greater than 5 microns. This creates uniform filtered solution flow through each pipe that minimizes chemistry depletion.

The solution flow also works in conjunction with the bunk design to help push out the hydrogen gas that is generated by the plating reaction. An issue that is not addressed by simply having solution flow from a header by gravity or pumping is the efficient removal of hydrogen gas evolved by the plating process. With primitive designs such as shown in (Wang U.S. Pat. No. 8,387,555) the hydrogen gas would not be efficiently removed and the result would be a poor thickness distribution of coating from top to bottom on the finished pipe. One clear innovation of the MAC system is the recognition of this issue of hydrogen collection along the upper inside surface of the pipes and implementation of equipment design within the fixturing bunks that works in combination of the solution flow system to achieve effective continuous removal of the hydrogen gas under different flow regimes with resulting good top to bottom distribution of the ENC as well as the good end to end distribution. Many factors come into play when developing the hydrogen release system for horizontal part processing including the velocity of the escaping gas/process bath mixture.

Figure 3:
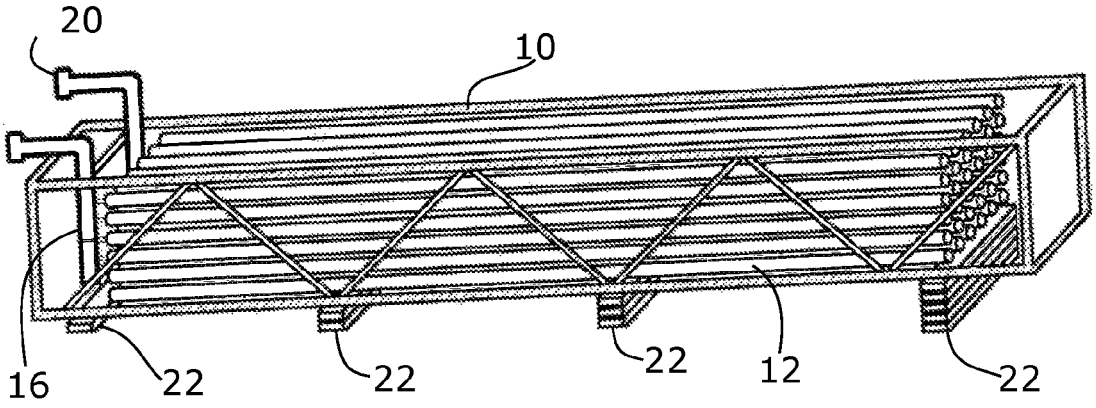
FIG. 3 is a side perspective view of the bunk of FIG. 2 showing spacers to orient the bunk at an angle.
Figure 4:
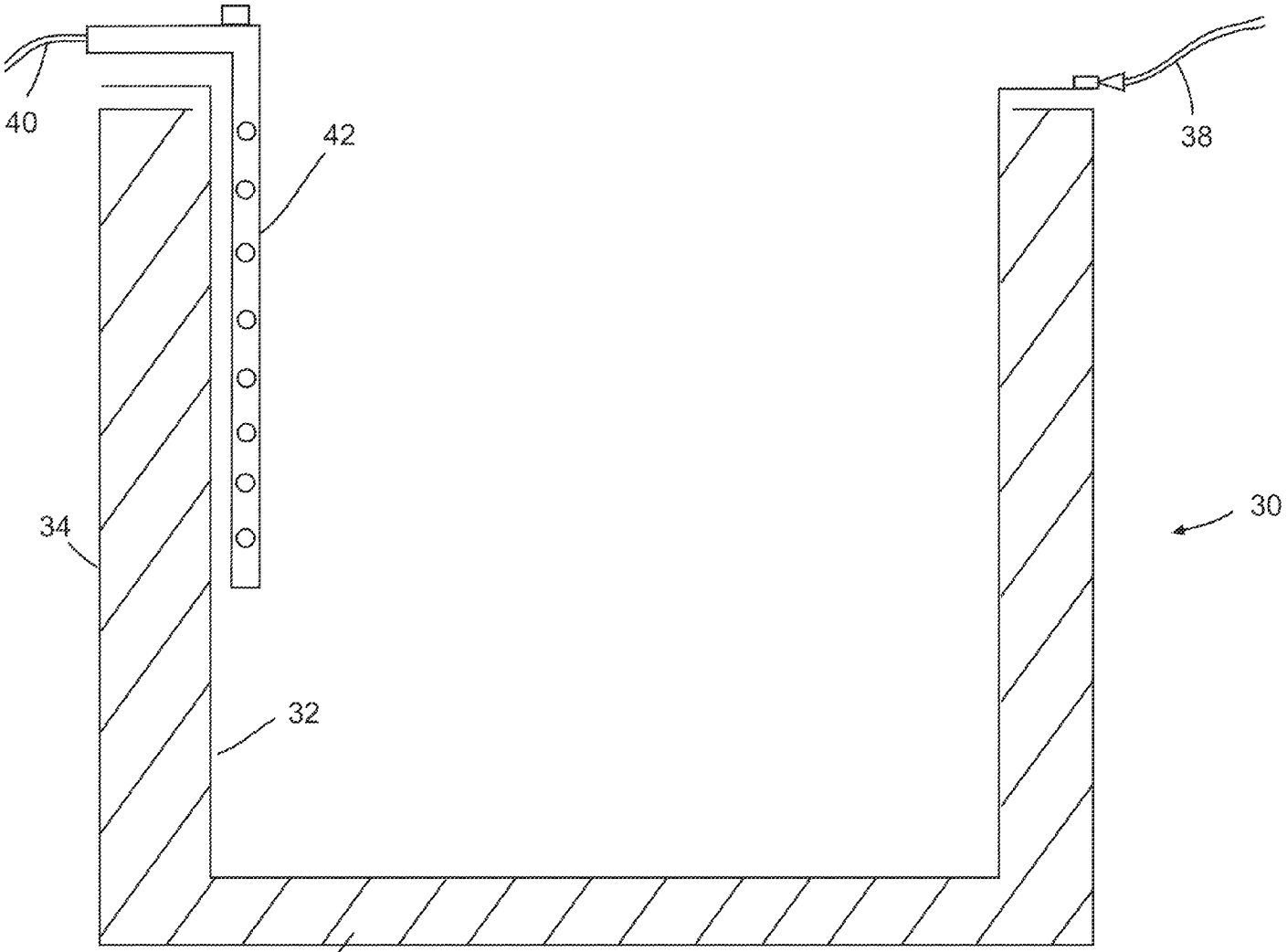
FIG. 4 is an end cutaway view of a tank into which a bunk may be placed.

Each loaded bunk is insulated from contacting the stainless steel plating tank that is equipped with a continuous passivation system to minimize tank plate out. An example tank 30 is shown in FIG. 4. The tank 30 comprises an inner portion 32, comprising for example AISI 316L stainless steel, and an outer portion 34 which may comprise for example painted steel. Insulation 36 separates the inner and outer portions. The inner portion is electrically connected to a positive terminal of a passivation unit (not shown) by wire 38. Wire 40 electrically connects a negative terminal of the passivation unit to a cathode 42 suspended in the plating solution (not shown) within the tank. The bunks are also designed to position the load at a predetermined angle that works in conjunction with the flow system to effective displace the hydrogen gas and prevent pooling of said gas along the upper surface of the pipes. The angle is preferably between 0 and 30 degrees from horizontal, the particular angle varying depending on the type of parts. FIG. 3 shows a bunk 10 oriented at an angle using spacers 22, which may comprise for example polypropylene. It has been determined that there is a nominal combination of flow rate and design angle of the bunk to yield optimum results. Too much flow or an incorrect angle and result in too much velocity of escaping gas and/or solution resulting in poor end results on the pipe. The angle of the load is regulated depending on the size characteristics of the parts being processed. The Mac system utilizes stainless steel alloy in the fixturing and the process tanks with anodic protection to minimize plating on undesired surfaces. With this system in excess of 99% of nickel chemistry is applied to the areas where coating is required.

Another recognized need that was addressed by the MAC system is the minimal presence of roughness on the inside of the pipe after coating. Roughness resulting from particulates being imbedded in the coating result in poor corrosion properties of the coating. The MAC system utilizes high performance filtration on all flows of bath chemistry entering the pipe. This is a critical aspect to achieving the end users requirements and is unique to the MAC coatings system.

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The invention claimed is:

1. A method of coating tubulars, the method comprising:

immersing the tubulars in electroless nickel coating solution, whereby hydrogen gas is produced, the tubulars each having an upper surface and being oriented in the electroless nickel coating solution at an angle greater than 0 degrees sufficient to displace the displace the hydrogen gas and prevent pooling of the hydrogen gas along the upper surface of each tubular; and providing a flow of the electroless nickel coating solution through the tubulars to coat the tubulars.

2. The method of claim 1 further comprising treating the tubulars prior to coating by an acid free process including, washing the tubulars in an alkaline washing solution and rinsing the tubulars in an alkaline rinsing solution before immersing the tubulars in the electroless nickel coating solution.

3. The method of claim 2 in which treating the tubulars prior to coating further comprises blasting the tubulars with a clean medium prior to washing the tubulars.

4. The method of claim 1 in which the tubulars are immersed in the electroless nickel coating solution in a tank from which the tubulars are electrically separated, and the tank is provided with anodic protection to prevent coating of the tank.

5. The method of claim 1 in which the tubulars are each provided with a wrapping to prevent coating of a respective outer portion of the tubular.

6. The method of claim 5 in which the wrapping comprises LLDPE (linear low-density polyethylene) stretch wrap.

7. The method of claim 5 in which the tubulars are arranged in a bunk and the step of immersing the tubulars in electroless nickel coating solution to coat the tubulars occurs while the tubulars are arranged in the bunk.

8. The method of claim 1 in which the tubulars are arranged in a bunk and the step of immersing the tubulars in electroless nickel coating solution to coat the tubulars occurs while the tubulars are arranged in the bunk.

9. The method of claim 8 in which electroless nickel coating solution flow is provided through the tubulars from nozzles on a header assembly attached to the bunk.

10. The method of claim 9 in which the electroless nickel coating solution enters the header assembly via a flow path comprising a filter.

11. A method of coating tubulars, the method comprising:

treating the tubulars prior to coating by an acid free process including washing the tubulars in an alkaline washing solution while brushing the tubulars inside and outside, and rinsing the tubulars in an alkaline rinsing solution while brushing the tubulars inside and outside; and immersing the tubulars in electroless nickel coating solution to coat the tubulars.

12. The method of claim 11 in which treating the tubulars prior to coating further comprises blasting the tubulars with a clean medium prior to washing the tubulars.

13. The method of claim 11 in which the tubulars are immersed in the electroless nickel coating solution in a tank from which the tubulars are electrically separated, and the tank is provided with anodic protection to prevent coating of the tank.

14. The method of claim 11 in which the tubulars are each provided with a wrapping to prevent coating of a respective outer portion of the tubular.

15. The method of claim 14 in which the wrapping comprises LLDPE (linear low-density polyethylene) stretch wrap.

16. The method of claim 11 in which the tubulars are arranged in a bunk and the step of immersing the tubulars in electroless nickel coating solution to coat the tubulars occurs while the tubulars are arranged in the bunk.

17. The method of claim 16 in which electroless nickel coating solution flow is provided through the tubulars from nozzles on a header assembly attached to the bunk.

18. The method of claim 17 in which the electroless nickel coating solution enters the header assembly via a flow path comprising a filter.

* * * * *